United States Patent [19]

Green et al.

[11] 3,948,226

[45] Apr. 6, 1976

[54] INTERNAL COMBUSTION ENGINE

[76] Inventors: Edward Howard Green, 11 Army Trail Road; Edward Howard Green, Jr., 21 N. Wisconsin Ave., both of Addison, Ill. 60101

[22] Filed: Sept. 25, 1973

[21] Appl. No.: 400,580

Related U.S. Application Data

[63] Continuation-in-part of Ser. No. 286,294, Sept. 5, 1972, Pat. No. 3,871,337.

[52] U.S. Cl. ..... 123/18 R

[51] Int. Cl.[2] ..... F02B 53/06

[58] Field of Search ..... 123/18 R; 91/339; 417/481; 418/34

[56] References Cited

UNITED STATES PATENTS

| | | | |
|---|---|---|---|
| 638,570 | 12/1899 | Forsyth | 123/18 R UX |
| 1,069,936 | 8/1913 | Frank | 123/18 R |
| 1,209,204 | 12/1916 | Richards | 123/18 R |
| 1,236,009 | 8/1917 | Saunders | 123/18 R X |
| 1,283,375 | 10/1918 | Vlk | 123/18 R |
| 1,596,375 | 8/1926 | Riesenecker | 418/34 X |
| 2,257,884 | 10/1941 | Mize | 123/18 R |
| 3,612,007 | 10/1971 | Balve | 123/18 R |

FOREIGN PATENTS OR APPLICATIONS

| | | | |
|---|---|---|---|
| 1,367,633 | 6/1964 | France | 123/18 R |
| 800,753 | 5/1936 | France | 123/18 R |
| 248,885 | 3/1926 | United Kingdom | 417/481 |

*Primary Examiner*—Carlton R. Croyle
*Assistant Examiner*—Michael Koczo, Jr.
*Attorney, Agent, or Firm*—Perry Carvellas

[57] ABSTRACT

An internal combustion engine comprising a translation case or gear case, a combustion chamber and a rotary valve. The rotary valve is adjacent to and on one side of the combustion chamber. The combustion chamber contains a rectangular piston plate. The piston plate is hinged at one end to a shaft and adapted for oscillatory movement in the combustion chamber. The walls of the combustion chamber are formed by the inner wall of a first circular disc, the inner wall of a second circular disc, the inner wall surfaces of the engine block and the surface of the piston plate. The rectangular piston plate is integral with or fixedly connected to the shaft, which shaft is fixedly connected to a first linking means. The piston plate, shaft and first linking means are movably connected to a second linking means, a throw and a drive gear.

The fixed relationship between the piston plate, shaft and first linking means and their movable relationship to the second linking means, throw and drive gear are such that during the combustion-power cycle, when a compressed fuel-air mixture is burned in the combustion chamber the pistion plate is made to oscillate. The oscillatory motion of the piston plate through the action of the linking means and throw is translated to rotary motion of the drive gear. The engine has a main shaft which is fixedly connected to a main gear and the rotary valve. The drive gear drives against the main gear causing rotation of the main gear, the main shaft and the rotary valve relative to the combustion chamber and translation case.

The rotary valve provides means for removal of the combustion gases from the combustion chamber and for the introduction of fuel into the combustion chamber.

19 Claims, 14 Drawing Figures

INTERNAL COMBUSTION ENGINE

CROSS REFERENCE TO RELATED APPLICATION

This application is a continuation-in-part of applicants' copending earlier filed application Ser. No. 286,294, filed Sept. 5, 1972, and now U.S. Pat. No. 3,871,337.

BACKGROUND OF THE INVENTION

The principle characteristic of rotary internal combustion engines are well known. Engines of that type generally convert the pressure of the expanding combustion gases to rotary motion more efficiently than do reciprocating engines of the same size, weight and displacement and they eliminate the need for conventional valves and their associated mechanisms, timing gears, cams and cam followers.

However, previously known rotary engines, for example, of the rotary piston type, though capable of producing relatively high power output for their weight and size have generally in operation exhibited excessively high wear and short useful life of the moving parts and relatively high fuel consumption. In operation, they generally have excessively high unburned or partially burned hydrocarbons in their exhausts which add to the problems of air pollution.

A second type of rotary engine which utilizes oscillating piston plates similar to the type described herein have generally been ineffective in changing the oscillatory motion of the piston plate to useful rotary motion.

One of the principal problems encountered with engines of this type was how to design for the lateral and radial expansion of the hot combustion chamber portion of the engine relative to the cooler gear and mechanical motion translation portion of the engine.

It is an object of this invention to provide an internal combustion engine which is relatively simple, compact, inexpensive, easy to manufacture and capable of generating a high power output for its weight and size.

Another object of the invention is to provide an engine which has a new and efficient means of translating the oscillatory motion of the rectangular piston plate to rotary motion of the main gear and main shaft.

A further object of the invention is to provide an engine of the type described herein which is capable of having the oscillatory motion of the piston plate, in sequence, accomplish the functions of exhaust, intake, compression and combustion-power.

Another object of the present invention is to provide an internal combustion engine with a rotary valve means for removal of combustion gases and the introduction of fuel.

Another object of the present invention is to provide for the lateral and radial heat expansion of the combustion chamber portion of the engine relative to the cooler gear and mechanical motion translation portion of the engine.

Another object of the invention is to provide an internal combustion engine which is easy to maintain.

A brief description of the figures of the drawings is given below.

Figure 13:
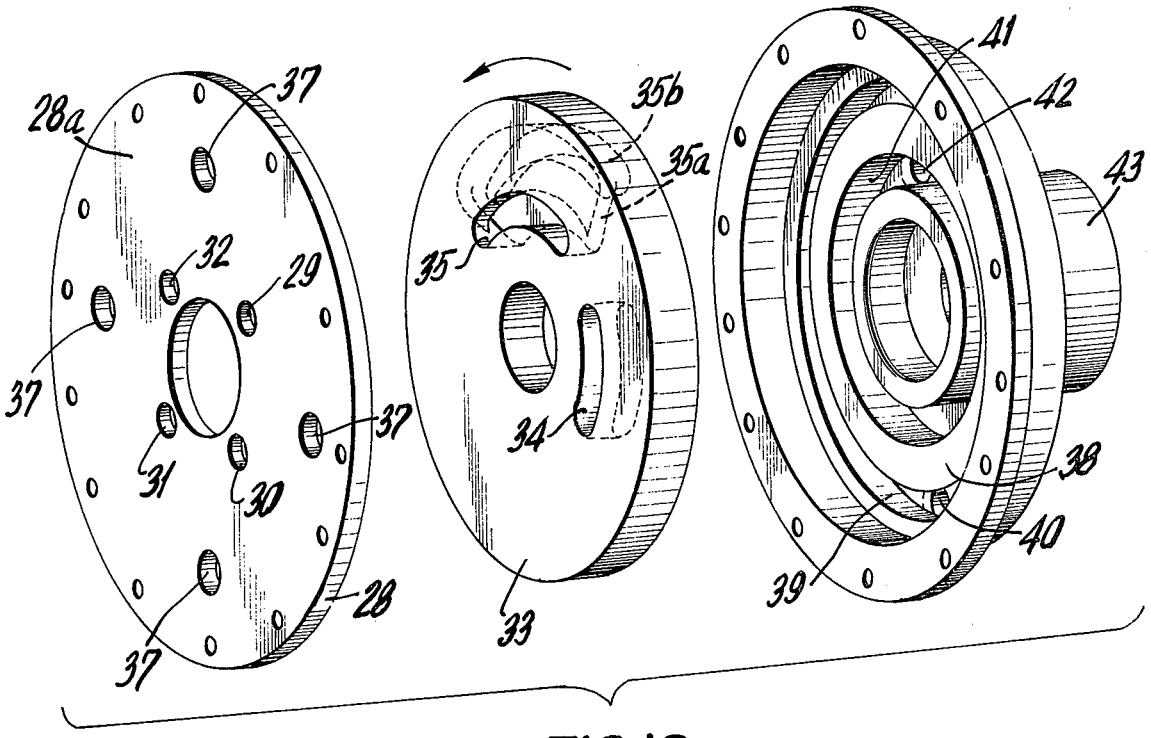

FIG. 13 is a three dimensional expanded view showing the second circular disc 28, rotary valve 33 and end plate 38.

Figure 1:
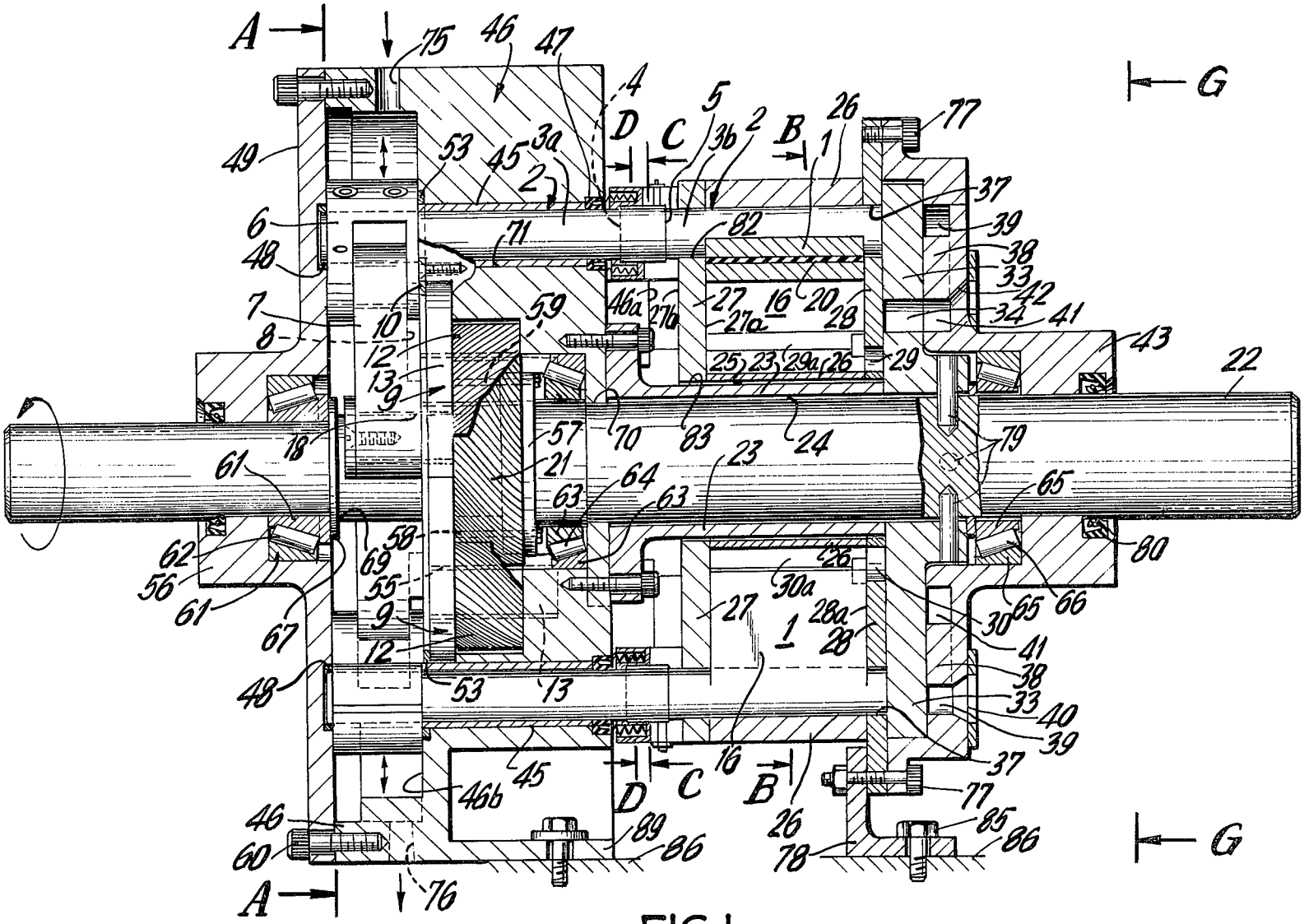
FIG. 1 is a cross-section of a preferred embodiment taken along a vertical line generally through the central axis. For purposes of clarity the drive gear and main gear are shown in elevation.
Figure 14:
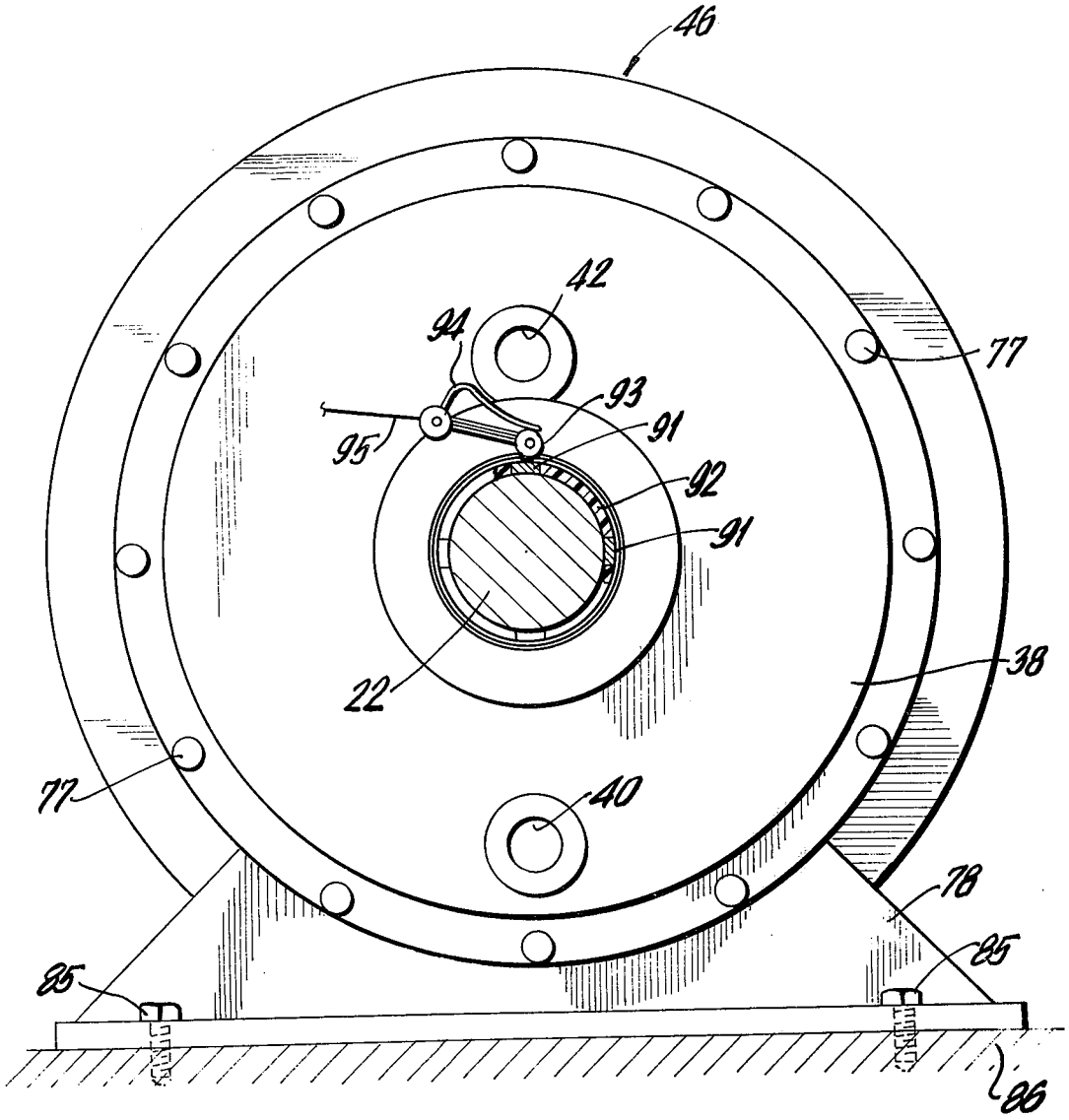

FIG. 14 is an end view taken generally along line G—G of FIG. 1 looking in the direction indicated by the arrows showing fuel inlet means 42 and exhaust means 40.

DESCRIPTION OF THE INVENTION

This invention relates to a new and useful improvement in internal combustion engines. The invention particularly relates to an internal combustion engine which is compact and simple in design and yet capable of developing a large amount of power relative to its overall size and weight.

The invention more particularly relates to a novel four cycle internal combustion engine comprising oscillating piston plates. The oscillatory motion of the piston plates caused by the combustion of a compressed fuel-air mixture in the combustion chamber is effectively and efficiently translated or changed into useful rotary motion. The engine block of the engine of the present invention has one or more combustion chambers. Each chamber can be arranged to cooperate with the rectangular piston plate for single or dual firing.

A preferred embodiment of the engine of the present invention comprises a four-cycle engine. An illustration of this embodiment is an engine having four combustion chambers spaced 90° apart. Each chamber has means for dual firing which effectively provides "eight" combustion chambers. The combustion chambers are contained in an engine block. A rotary valve is provided on one side of the combustion chambers. The rotary valve rotates in a plane parallel to the combustion chambers and provides exhaust and intake means, in turn, to each combustion chamber. During each complete 360° revolution of the rotary valve two adjacent combustion chambers at the same time and in turn, go through the four cycles of exhaust, intake, compression and ignition (combustion-power). The rotary valve is fixedly connected to the main shaft and rotates with the main shaft.

An ignition means for the combustion chamber is provided in the outer portion of the engine block. In the dual firing embodiment, combustion chambers are formed on each side of the rectangular piston plate. The chambers are formed by the piston plate surfaces, the engine block and the first and second circular discs.

The rotary valve contains an exhaust groove and an inlet groove. The second circular disc has four ports spaced 90° apart, which communicate with the four combustion chambers. The ports in turn function as both exhaust ports and inlet ports.

During each 360° rotation of the rotary valve, the rotary valve exhaust groove and inlet groove come into contact with the ports in the second circular disc and through the ports the exhaust groove and inlet groove communicate with the combustion chambers.

Each rectangular piston plate in each chamber oscillates twice in each direction for one revolution of the rotary valve. In the dual firing embodiment the rotation of the rotary valve exhaust groove and inlet groove passed the ports in the second circular disc is coordinated with the oscillation of the rectangular piston plates such that two combustion chambers at the same time in turn go through the four engine cycles.

The operation of the engine briefly described is as follows. After completion of the combustion power cycle the piston plates oscillate back towards a port which has just been opened by the exhaust groove of the rotary valve such that the spent combustion gases are expelled through the open port and the exhaust groove. The opened port closes at the end of the exhaust cycle and then opens to permit fuel-air mixture to enter through the open port and the inlet groove in the rotary valve during the intake cycle which follows. During the fuel intake cycle, the rectangular piston plates move away from the open port to draw the fuel-air mixture through the port and into the combustion chambers. After the fuel intake cycle, the port is closed by the rotary valve. The plates then oscillate towards the now closed port to compress the fuel air mixture. At the proper time the compressed mixture will be ignited by ignition means which starts the combustion-power cycle causing the piston plates to oscillate away from the closed port. After completion of the combustion power cycle, the port is again opened by the exhaust groove in the rotary valve and the piston plates oscillate towards the opened port to exhaust the combustion gases through the port and the exhaust groove. The four cycles then begin again.

Figure 6:
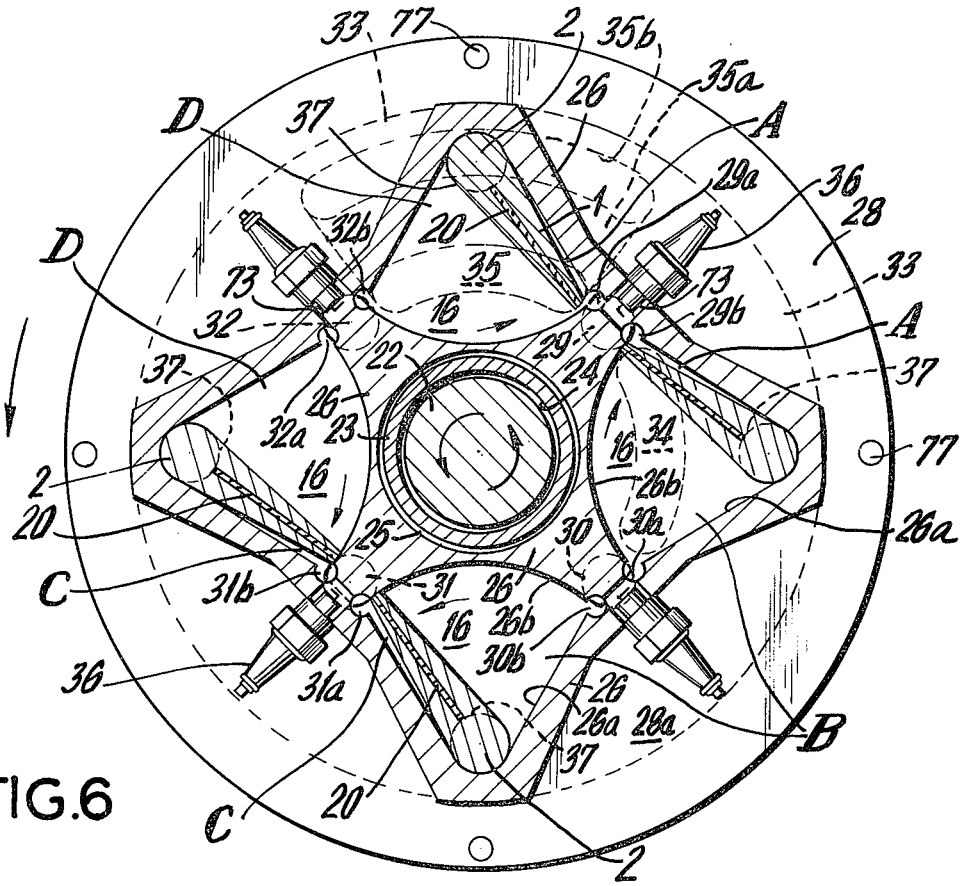
FIG. 6 is a vertical section taken generally along line B—B of FIG. 1 looking in the direction indicated by the arrows showing four combustion chambers arranged for dual firing in the various cycles of exhaust, fuel intake, compression and combustion-power.

A more detailed description of the operation of the engine is given with reference to FIGS. 6 and 13 of the drawings in which combustion chambers A, B, C and D in each of the cycles of exhaust, intake, compression and combustion are discussed. The discussion is with reference to the dual firing embodiment of the invention.

The combustion chambers A as shown in FIG. 6 have just completed the exhaust cycle. In carrying out the exhaust cycle, exhaust groove 35 in rotary valve 33 rotated counter-clockwise first in communication with port 29, channels 29(*a*, *b*) and combustion chambers A and then passed and out of communication with port 29 and combustion chambers A and channels 29(*a*, *b*). During the counter-clockwise rotation of rotary valve 33, port 29 which was closed, was opened by exhaust groove 35, was closed, was opened again by inlet groove 34 and then closed again.

Prior to the exhaust cycle, combustion chambers A and previously undergone a combustion-power cycle. At the end of the combustion-power cycle, the piston plates were on the opposite side of the combustion chambers A, i.e. away from port 29. As the piston plates 1 commenced their oscillating motion towards port 29, the left hand or leading edge of the exhaust groove 35 first came into contact with port 29 and channels 29(*a*, *b*). While the piston plates oscillate towards port 29 and during the time the exhaust groove 35 is in communication with port 29, the combustion gases are expelled through port 29 and channels 29(*a*, *b*) and exhaust groove 35.

In the position shown in the drawing, combustion chambers A have completed the exhaust cycle and are at the moment isolated from both the exhaust groove 35 and the fuel inlet groove 34. It is noted that in FIG. 6 of the drawings the channel portions 29(*a*, *b*) are in the engine block 26 and the port 29 is below the engine block in the second circular disc 28. The exhaust groove 35 and the fuel intake groove 34 are in rotary valve 33 which is below the second circular disc 28.

During the time the combustion chambers A are going through the exhaust cycle, combustion chambers B are going through the fuel intake cycle. During the fuel intake cycle, a fuel-air mixture in vapor phase is fed through fuel inlet port 42 in end plate 38, through inlet groove 34 in rotary valve 33, through port 30 in second circular disc 28 and into combustion chambers B.

Combustion chambers B as shown in FIG. 6 of the drawings have completed the intake cycle. The rotary valve 33 and fuel inlet groove 34 rotate counter-clockwise and groove 34 comes into communication with and opens port 30 in the second circular disc 28. When the leading edge of intake groove 34 first comes into contact with port 30 and channels 30(*a*, *b*), the rectangular piston plates 1 are at a position adjacent to port 30. As the fuel inlet groove 34 continues its movement in a counter-clockwise direction and groove 34 comes more fully into communication with port 30, the piston plates 1 oscillate away from port 30 to the position shown in the drawing. When the piston plates 1 have reached this point, the fuel inlet groove 34 has rotated passed and out of communication with port 30, closing port 30.

As shown in FIG. 6 of the drawing, while the two adjacent combustion chambers A are in the completed exhaust position and the two adjacent combustion chambers B are in the completed fuel intake position, the exhaust groove 35 and the fuel inlet groove 34 are not in communication with either combustion chambers A or combustion chambers B.

The combustion chambers C in the immediately preceding cycle had completed the fuel intake cycle as the fuel inlet groove 34 passed in a counter-clockwise direction first in communication with port 31 and channels 31(*a*, *b*), to open port 31, and then out of communication with port 31 and channels 31(*a*, *b*), to close port 31. During the time the fuel inlet groove 34 rotated 90° in a counter-clockwise direction to the position shown in FIG. 6, the rectangular piston plates in combustion chambers C oscillated from a position away from port 31 to a position adjacent port 31, to compress the fuel-air mixture in chambers C. In the position shown, the rectangular piston plates have just completed the compression cycle in combustion chambers C and the compressed fuel mixtures within the next instant will be ignited by the ignition means 36. On ignition of the compressed fuel mixture in combustion chambers C and with the continued counter-clockwise rotation of the rotary valve 33, the rectangular piston plates in chambers B will oscillate towards port 30 which is closed and compress the fuel mixture in combustion chambers B, while the piston plates in chambers D will oscillate toward port 32 and will exhaust the combustion gases in chambers D through port 32, channels 32(*a*, *b*) and exhaust groove 35.

The combustion chambers D have in the position shown just completed the combustion-power cycle. Visualize in the immediately proceeding cycle, while the chambers D were in the full compression cycle, the leading or left hand edge of the exhaust groove 35 was just approaching port 29 but was not yet in communication with port 29. During the combustion-power cycle of combustion chambers D, the rectangular piston plates oscillated away from port 32 while the exhaust groove 35 came into communication with port 29 and channels 29(*a*, *b*) allowing the combustion gases in combustion chambers A to be expelled through port 29 and exhaust groove 35.

As shown in the drawing, port 32 is closed and combustion chambers D are isolated from exhaust groove 35. The rotary valve 33 rotates in a counter-clockwise direction and the exhaust groove 35 comes into contact with port 32 and opens port 32. Through the open port 32, and channels 32(*a*, *b*), combustion chambers D communicate with exhaust groove 35 and the exhaust cycle of combustion chambers D is carried out.

It can be seen from the above that each 90° counter-clockwise rotation of the rotary valve 33 is coordinated with the oscillatory movement of the rectangular piston plates in the combustion chambers 16.

The exhaust groove 35 and the fuel inlet groove 34 in the rotary valve 33, the ports 29, 30, 31, and 32 in the second circular disc 28 and the channels 29(*a*, *b*), 30(*a*, *b*), 31(*a*, *b*) and 32(*a*, *b*) in the engine block are dimensioned such that in the positions shown in FIG. 6 of the drawings there is no communication between the exhaust groove or the inlet groove and any of the chambers 16.

In operation of the engine any two adjacent piston plates oscillate away from each other or towards each other. Visualize the two rectangular piston plates 1 oscillating towards port 29, while the two opposite rectangular piston plates 1 oscillate towards port 31. As each of the four piston plates reach the end of their travel, they reverse themselves and then travel in the opposite direction. This oscillatory motion occurs twice for each piston plate per 360° revolution of the rotary valve 33. The four engine cycles of exhaust, intake, compression and combustion-power take place continuously for each of the combustion chambers, two chambers at a time (dual embodiment), once per 360° revolution of the rotary valve 33.

The operation of the engine power provides a balanced almost continuous smooth power output by providing one or two power cycles for each of the combustion chambers per revolution of rotary valve 33 and of the main shaft of the engine.

The engine of the present invention provides substantial advantages in engineering, manufacturing and design improvements over conventional engines of comparable size including: more horsepower per weight of engine, more mileage per gallon, fewer total parts, fewer moving parts, simplified ignition, a rotary valve fuel intake and exhaust system, smooth continuous combustion-power output, very light and compact per cc of displacement and horsepower, simplicity of manufacture, assembly and maintenance, and high degree of reliability and useful life.

Another advantage is that the engine performs all the functions of an internal combustion engine without the use of conventional intake and exhaust valves and all the complex mechanism normally required for the timing and operation of such valves.

Another advantage of the construction of the engine is that it provides a simplified means of ignition. Once started the engine can have automatic self-ignition. For example, after the engine has been started and is in operation automatic ignition can be obtained by diesel engine type firing.

A further advantage of the present invention is that the means for lubricating and cooling the engine operates as a sealed unit. The lubricating oil is not exposed to the atmosphere and can thus not volatilize. The lubricating oil is not directly exposed to the combustion chambers and thus is not subjected to oxydative degradation. Both of these features act to minimize air pollution that may result from operation of the engine.

A specific advantage of the present invention as compared to a conventional reciprocating internal combustion engine is that the engine of the present invention can provide, in the dual firing embodiment, two power strokes per combustion chamber 16, for each complete revolution of the rotary valve and drive shaft, whereas the conventional engine provides only one power stroke per two complete revolutions of the drive shaft. The engine of the present invention is thus capable of producing about two to four times the power of a conventional engine of the same number of chambers and displacement.

Other advantages of the present invention will become obvious to those skilled in the art by the following description of the accompanying figures of the drawings.

In the description that follows, like reference numerals indicate like parts.

FIG. 1

FIG. 1 is an expanded side view taken through a vertical section along the central axis of the engine. FIG. 1 shows the overall construction of the engine including the translation case or gear case 46, the engine block 26 and combustion chambers 16, the piston plate 1 and shaft 2, linking means 6 and 7, drive gear 12, main gear 21, main shaft 22 and the rotary valve 33.

In the operation of the engine a fuel air mixture is fed through inlet 42 and the combustion products expelled through exhaust outlet 40.

Looking from left to right at the drawing, bolts 60 fixedly connect end disc 49 to translation case 46. End disc 49 has integral therewith cylindrical hub 56 through which main shaft 22 passes. Suitable oil sealing means, not shown, are provided between end disc 49 and the translation case 46. Shaft 22 is integral with or fixedly connected to flange 57 and main gear 21 is fixedly connected to flange 56 by drive dowels 58 and bolts 59. Flange 57 may be made as part of main shaft 22 or may be made separately and welded or otherwise fixedly attached to shaft 22. Shaft 22 passes through engine block 26, rotary valve 33 and end plate 38. A first circular disc 27 and a second circular disc 28 are fixedly connected to engine block 26 by suitable bolts, not shown.

Shaft 2 which is integral with the piston plate 1 is supported by end plate 49, translation case 46, first circular disc 27, engine block 26 and second circular disc 28.

The end plate 38 is fixedly connected to the second circular disc 28 by bolts 77 and is integral with cylindrical hub 43. The lower portion of the second circular disc 28 and end plate 38 have attached thereto legs 78 for securing the combustion chambers and rotary valve portion of the engine to a suitable base 86, e.g., an engine mount. The portions of the engine indicated as 89 in cooperation with suitable bolt means secure the translation or gear case portion of the engine to base 86.

The rotary valve 33 is positioned between the second circular disc 28 and the end plate 38. The main shaft 22 is connected to the rotary valve 33 by four connecting pins 79 and rotates with the rotary valve and relative to the second circular disc 28 and end plate 38. The pins 79 are free standing in the main shaft 22 and allow radial expansion of the rotary valve 33. Cylindrical collar 23 is a metal heat shield which protects the main shaft 22 from the heat of the combustion chambers 16. Annular oil space 24 provides lubrication and annular air space 25 provides heat insulation and protection for the main shaft 22 from the heat of the combustion chambers 16. End plate 38 on the right end of main shaft 22 has passing therethrough fuel inlet port 42 and outlet port 40. Oil seal 80 prevents leakage of oil from around the main shaft 22.

The rotary valve 33 cooperates with the second circular disc 28 and the end plate 38 to provide inlet means for the fuel and air mixture to the combustion chambers and an exhaust means for the combustion products by at the proper time and in the proper sequence opening and closing ports 32, 31, 30 and 29.

The walls of combustion chamber 16 are formed by the inner wall surface 27*a* of the first circular disc 27, the inner wall surface 28*a* of the second circular disc 28, the surfaces of the engine block 26 and the surfaces of piston plate 1.

The rectangular piston plate 1 is integrally connected to shaft 2, which shaft is in turn fixedly connected to a first linking means 6. The piston plate 1, shaft 2 and first linking means 6 are movably connected to a second linking means 7, throw 9 and drive gear 12 whereby the oscillatory motion of the piston plate is changed into a rotary motion of the drive gear 12. The drive gear 12 is movably connected to shaft 13 by bearing means 55. Shaft 13 is fixedly connected to translation case 46. Throw 9 and drive gear 12 are fixedly connected and rotate together around the axis of shaft 13.

The rectangular piston plates 1 oscillate with shaft 2 in combustion chambers 16. Shaft 2 is supported by bearing means 45 in translation case 46 and is sealed by oil seal means 47. Bearing means 45 forms a thrust face 53 which seats in a recess formed in translation case 46. Shaft 2 is also supported by bearing 48 which seats in a recess formed in end disc 49. Thrust bearing raceways 61 and thrust bearing 62, thrust bearing raceways 63 and thrust bearing 64 and thrust bearing raceways 65 and thrust bearing 66 provide support and bearing means for main shaft 22 and main shaft 22 rotates on the bearings. A socket for raceway 61 is formed in the hub 56 portion of end disc 49; a socket for raceway 63 is formed in translation case 46, and a socket for raceway 65 is formed in the hub 43 portion of end plate 38. A small shoulder 69 formed on main shaft 22 locates washer 67 for cooperation with thrust bearing 62. Flange 57 positions thrust bearing 64. Thrust bearing 62 and washer 67 in cooperation with thrust bearing 64 and flange 57 prevent lateral movement of shaft 22 in translation case 46.

The inside of the translation case 46 is filled with oil to cool and lubricate the moving parts. The oil is supplied through oil inlet port 75 and passes through and around the moving parts including link 6, link 7, throw 9, drive gear 12 and main gear 21 and leaves the translation case through oil outlet port 76. The cooling and lubricating oil is in a sealed system and the oil is not exposed to the atmosphere or combustion gases. The warm oil is cooled externally by suitable heat exchange means and recycled to the engine.

Figure 2:
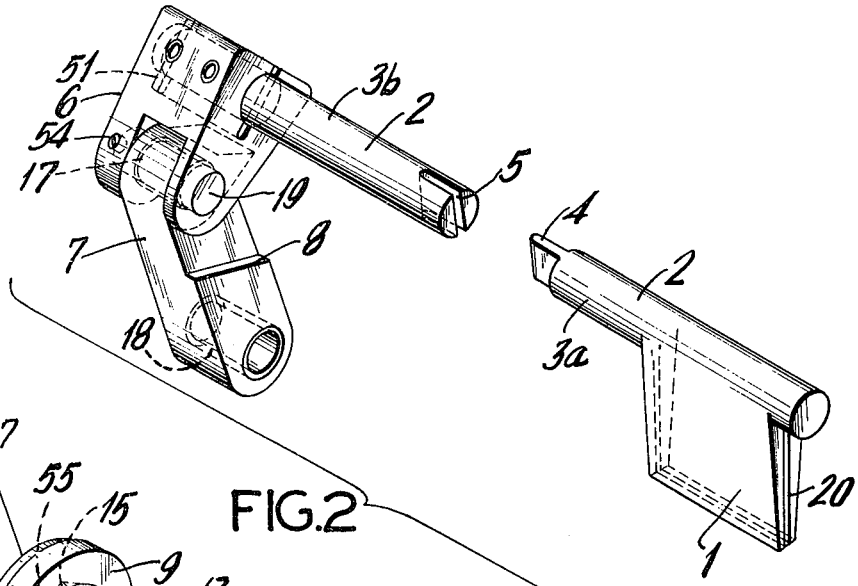
FIG. 2 is an isometric drawing of the rectangular piston plate and the related fixed and moving parts.
Figure 3:
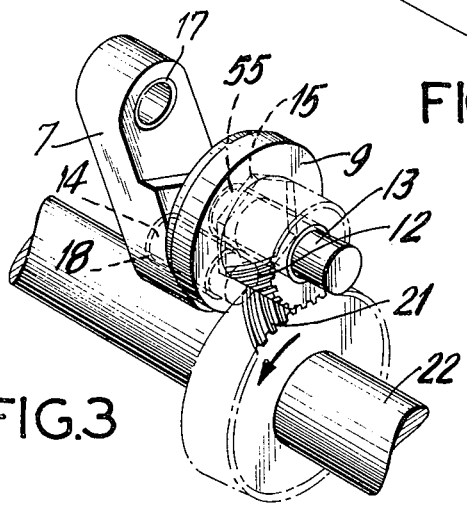
FIG. 3 is an isometric drawing of the connecting links, throw, drive gear, main gear and main shaft.

FIGS. 2 and 3

There are two parts, part 3*a* and 3*b* to shaft 2. Shaft 2 is fixedly connected to link 6 by key 51. There are two legs to link 6. Shaft 19 passes through the two legs and through link 7, operably connecting link 6 to link 7. Shaft 19 is fixedly connected to link 6 by pin 54. Bearing means 17 provides a movable connecting means between shaft 19 and link 7. Shaft 14 is integral with throw 9 and extends through link 7. Link 7 is movably connected by bearing means 18 to shaft 14. Throw 9 is fixedly connected to drive gear 12, by hexagonal portion 15 of gear 12 which is inserted in the recess in the surface of throw 9. Shaft 13 extends through throw 9 and drive gear 12 and is fixedly connected to the translation case 46. Shaft 13 is movably connected to throw 9 and gear 12 by suitable bearing means 55.

Figure 4:
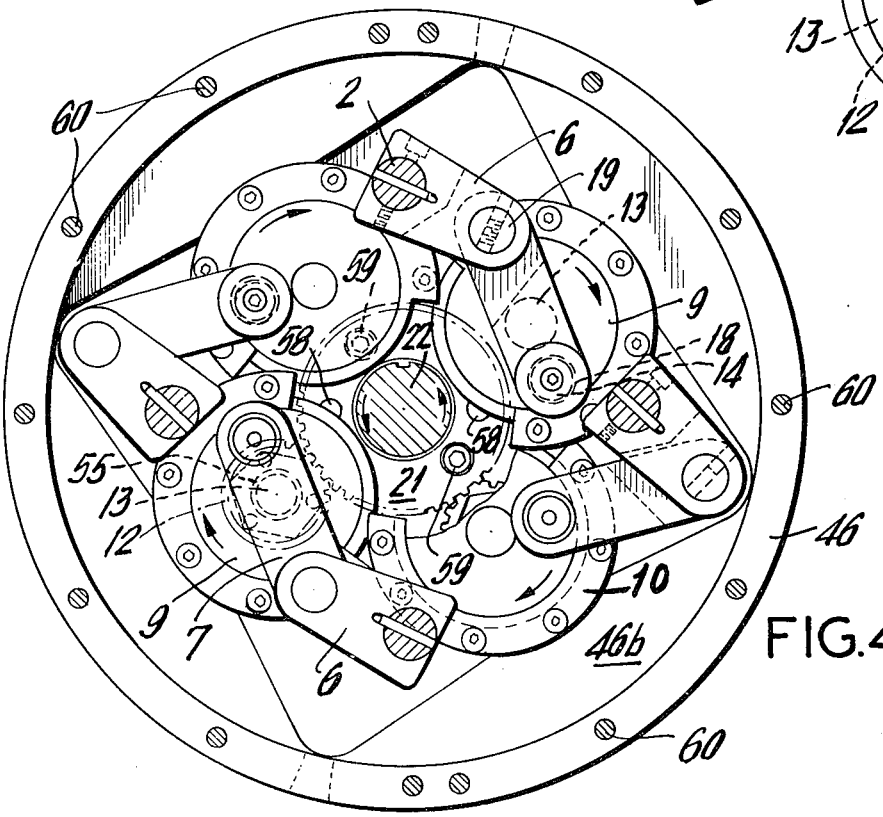
FIG. 4 is a vertical section taken generally along line A—A of FIG. 1 looking in the direction indicated by the arrows showing the relationship between the connecting links, throw, drive gear, main gear and main shaft.

The fixed relationship of rectangular piston plate 1, shaft 2 and connecting link 6 and the movable relationship of these parts with link 7, throw 9 and gear 12 causes the oscillatory motion of the rectangular piston plate back and forth in the combustion chamber 16 to be translated or changed into rotary motion of drive gear 12. Drive gear 12, see FIG. 5, rotates in a clockwise direction. The drive gear 12 drives against main gear 21 and causes the main gear 21 and main shaft 22 to which it is fixedly connected to rotate together in a counter-clockwise direction (FIG. 3). With reference to FIGS. 4 and 6 the rotation is also in a counter-clockwise direction and with reference to FIG. 1, the top of shaft 22 rotates away from the viewer. With reference to the rotary valve means 33, shown in FIG. 13, the rotation is counter-clockwise.

Piston plate 1 can have recesses on its side edges and outer edge in which recesses sealing and bearing means 20 can be placed. The sealing and bearing means can be pressed outwardly by suitable spring means not shown.

Figure 5:
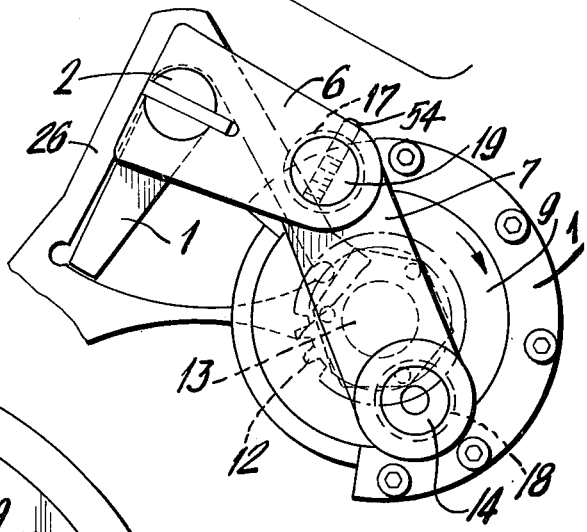
FIG. 5 is an enlarged schematic view of the arrangement of the rectangular piston plate, the first and second linking means, the throw, drive gear and a portion of the engine block.

FIGS. 4 and 5

FIG. 4 is a cross-section taken generally along line A—A of FIG. 1 looking in the direction indicated by the arrows showing the relationship between the connecting links 6 and 7, throw 9, drive gear 12, main gear 21 and shaft 22. The outer surface 46*b* of the translation case 46 can be seen in the background.

The translation case 46 supports shaft 13, throw 9 and gear 12. Shaft 13 is fixedly connected to the translation case. Gear 12 and throw 9 rotate around shaft 13 on bearing means 55 in a clockwise direction, causing rotation of main gear 21 and shaft 22 in a counterclockwise direction.

FIG. 5 is a slightly enlarged detailed view of the arrangement of the rectangular piston plate 1, shaft 2, linking means 6, linking means 7, throw 9, shaft 14 and drive gear 12. The relationship of shaft 19, pin 54 and bearing means 17 to linking means 6 and 7, and the relationship of bearing means 18 to linking means 7, shaft 14 and throw 9 are also shown.

The relative position, size and relationship of the links 6 and 7 are important in obtaining maximum power output from the engine.

FIG. 6

FIG. 6 is a vertical section taken generally along line B-B of FIG. 1 looking in the direction indicated by the arrows showing four chambers 16 arranged for dual firing in the various cycles of exhaust (position A), fuel intake (position B), compression (position C) and combustion-power (position D). (See discussion of engine operation above.) This figure shows the inner wall surfaces 26*a* of engine block 26, the surfaces of the piston plate 1 and the inner wall surface 28*a* of the second circular disc 28 which form walls of the combustion chamber. The drawing also shows in cross-section a view of the rectangular piston plate 1, shaft 2, insulating metal heat shield 23, and annular oil lubricating space 24, heating insulating space 25 and main shaft 22.

The ignition means 36, the piston plate 1 and the channels 29(*a*, *b*), 30(*a*, *b*), 31(*a*, *b*) and 32(*a*, *b*) are in the engine block 26. The second circular disc 28 is under engine block 26 and piston plate 1. The openings 37 are in the second circular disc 28. The ports 29, 30, 31 and 32 are also in the second circular disc 28.

The ports 29, 30, 31 and 32 communicate with the chambers 16, and the ignition means 36 through the channel means 29(*a*, *b*), 30(*a*, *b*), 31(*a*, *b*) and 32(*a*, *b*), respectively. The ignition 36 means is located in about the center of chamber 16 and communicates with chamber 16 through an opening 73 in the engine block 26.

The rotary valve 33 is under the second circular disc 28 and contains the exhaust groove 35 and inlet groove 34. The exhaust groove 35 and the fuel inlet groove 34 are about the same size and shape and are radially about the same distance from the center axis of the engine.

The exhaust groove 35 extends into the surface of rotary valve 33 but does not extend through rotary valve 33. Exhaust groove 35*b* is radially offset from groove 35. Exhaust groove 35*b* extends into the surface of the rotary valve on the side opposite groove 35, but does not extend through rotary valve 33. Grooves 35 and 35*b* communicate with each other through connecting channel 35*a*. The inlet groove 34 extends completely through the rotary valve 33.

FIG. 7

Figure 7:
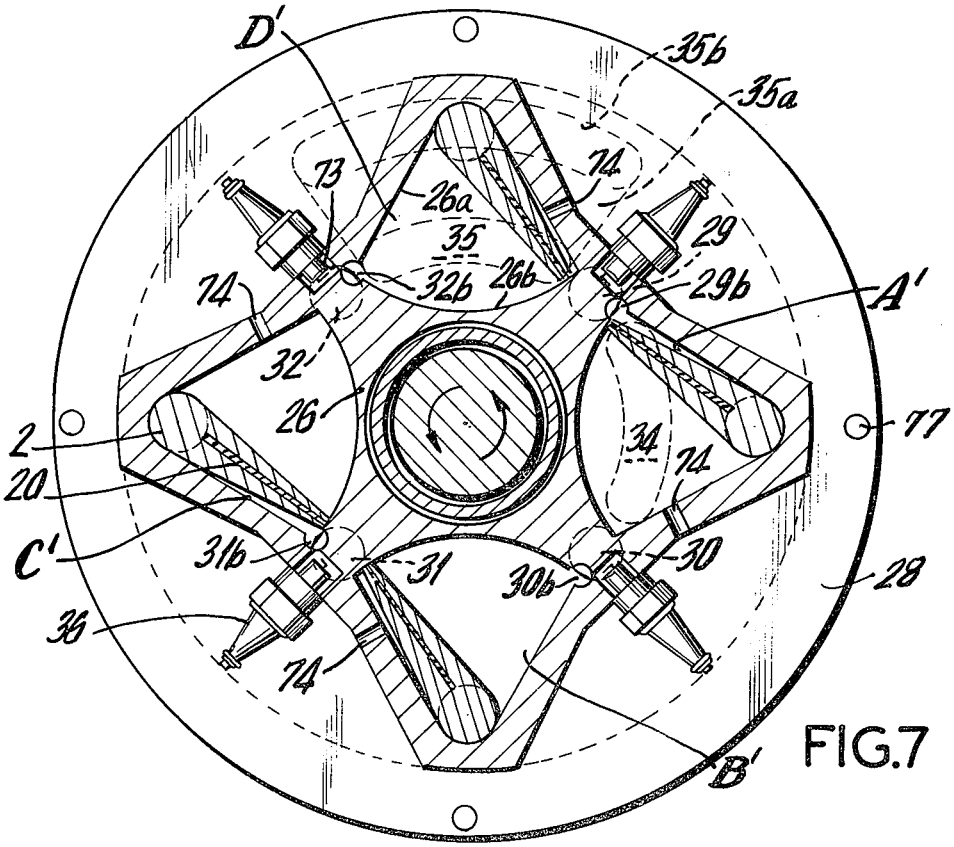
FIG. 7 is a vertical section of another embodiment of the invention showing the same view of the engine as shown in FIG. 6 in which embodiment the engine is arranged for single firing in each combustion chamber.

FIG. 7 is a vertical section of another embodiment of the invention showing essentially the same view of the engine as shown in FIG. 6. The engine, however, is arranged for single firing in each combustion chamber instead of dual firing. The operation of the engine except for the single firing is otherwise similar to that described above for the dual firing embodiment. The principal difference in structure is that the channels, 29*a*, 30*a*, 31*a* and 32*a* have been omitted. This prevents communication between chambers 16, on the side of the piston plates from which the channels have been omitted, with ignition means 36, ports 29, 30, 31 and 32 and the exhaust groove 35 and the inlet groove 34. To allow operation of the piston plates, the side of the chambers which do not fire are provided with a vent 74. The vent 74 allows movement of the piston plates in the side of the combustion chamber that does not fire, by allowing gas to vent in and out of the non-firing portion of the chamber. The vent 74 also provides a means for venting and collecting any blow-by gases from the combustion chambers 16. The collected gases, to reduce air pollution, can be recycled to the fuel intake means and burned.

FIG. 8

Figure 8:
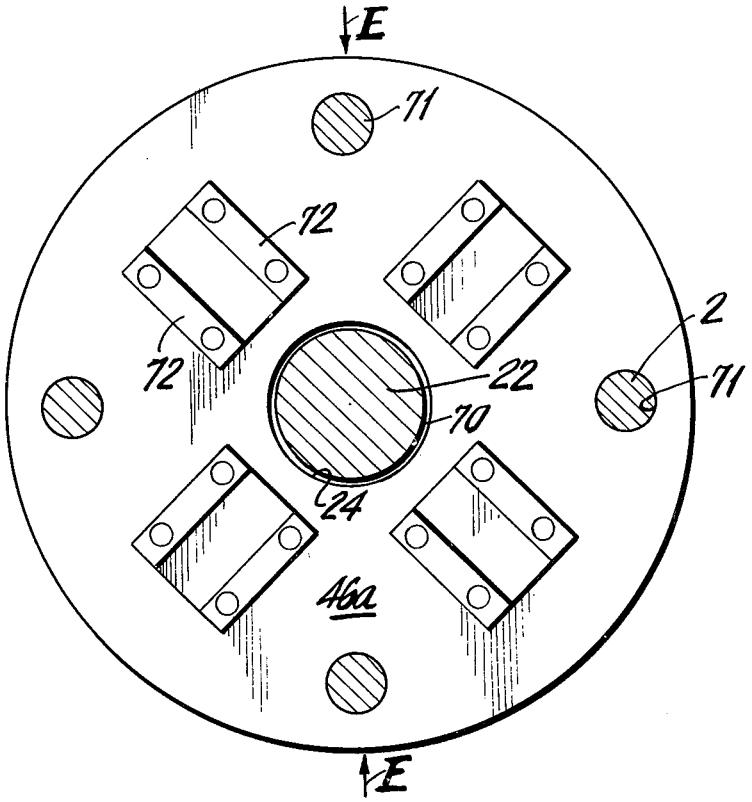
FIG. 8 is a vertical section taken generally along line C—C of FIG. 1 looking in the direction indicated by the arrows showing a view of surface 46*a* of the translation case 46.

FIG. 8 is a vertical section taken generally along the line C—C of FIG. 1 looking in the direction indicated by the arrows and showing a view of surface 46*a* of translation case 46. The main shaft 22 passes through circular opening 70. The shaft 2 passes through opening 71. Annular space 24 is filled with oil and provides lubrication for shaft 22. Expansion and support members 72 are bolted into the surface 46a of translation case 46. These expansion members have a tight sliding fit and cooperate with the expansion members 81 (FIG. 9) and allow longitudinal expansion and radial expansion of the hot engine block 26 portion of the engine relative to the cooler translation case 46 portion of the engine.

FIG. 9

Figure 9:
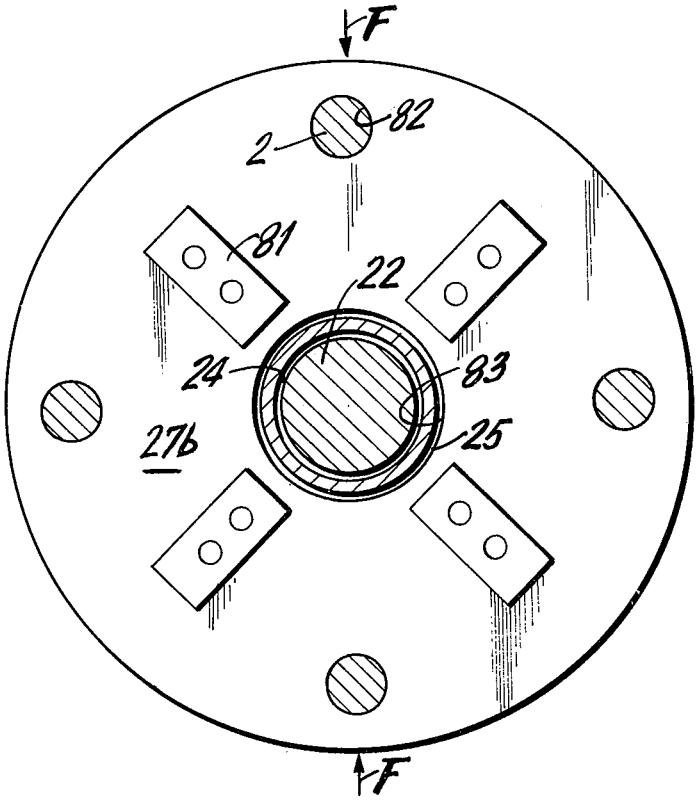
FIG. 9 is a vertical section taken generally along line D—D of FIG. 1 looking in the direction indicated by the arrows showing a view of surface 26*b* of the first circular disc 27.

FIG. 9 is a vertical section taken generally along line D—D of FIG. 1 looking in the direction indicated by the arrows showing a view and surface 27*b* of the first circular disc 27. The main shaft 22 passes through circular opening 83 and shaft 2 passes through opening 82. Annular space 24 is filled with lubricating oil. Annular space 25 is an air space which provides heat insulation for shaft 22. Expansion and support members 81 are bolted into the surface 27*b* of the first circular disc 27. The expansion members have a tight sliding fit and cooperate with the expansion members 72 (FIG. 8) and allow longitudinal expansion and radial expansion of the hot engine block 26 portion of the engine relative to the cooler translation case 46 portion of the engine.

FIG. 10

Figure 10:
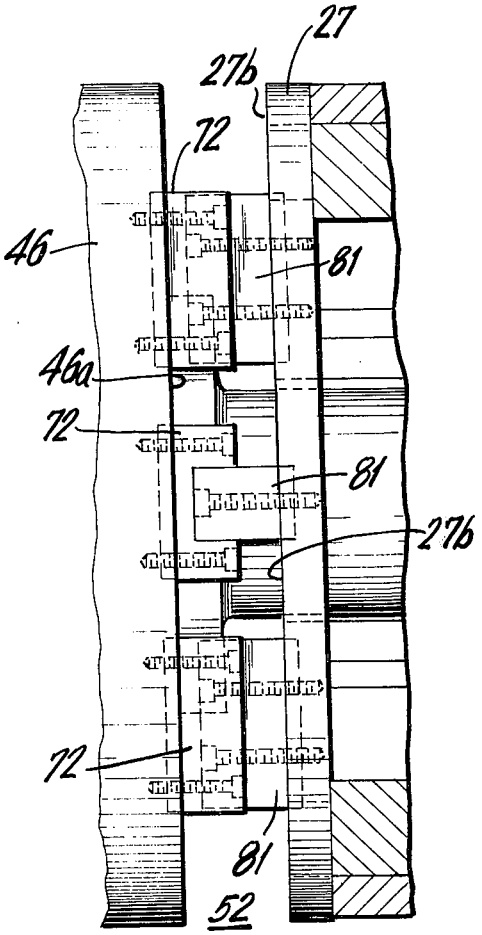
FIG. 10 is a detailed cross-section of FIGS. 8 and 9 taken generally along lines E and F respectively.

FIG. 10 is a detailed view of FIGS. 8 and 9 taken generally along line E and F, respectively. From this figure of the drawings, the longitudinal and radial heat expansion means can be more easily seen and understood.

Figure 11:
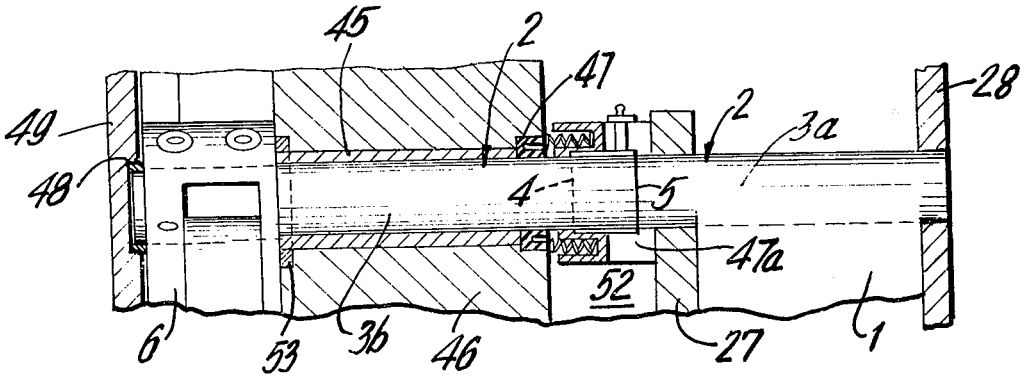
FIG. 11 is a vertical section taken through the center line of shaft 2.

FIG. 11 is a detailed view of the connecting means and expansion means provided for shaft 2. Shaft 2 can, in order to allow for heat expansion, be made in two parts, 3*a* and 3*b*. A two piece grease coupling 47*a* is provided for retention of lubrication of the end portions 3*a* and 3*b*. The coupling is spring loaded to allow lateral and radial heat expansion of the tongue 4 and groove 5 end portions. Shaft 2 has packing and oil seal gland 47 which sits in the wall of translation case 46. Seal 47 prevents seepage of oil from the interior of the translation case into the engine expansion space 52.

Figure 12:
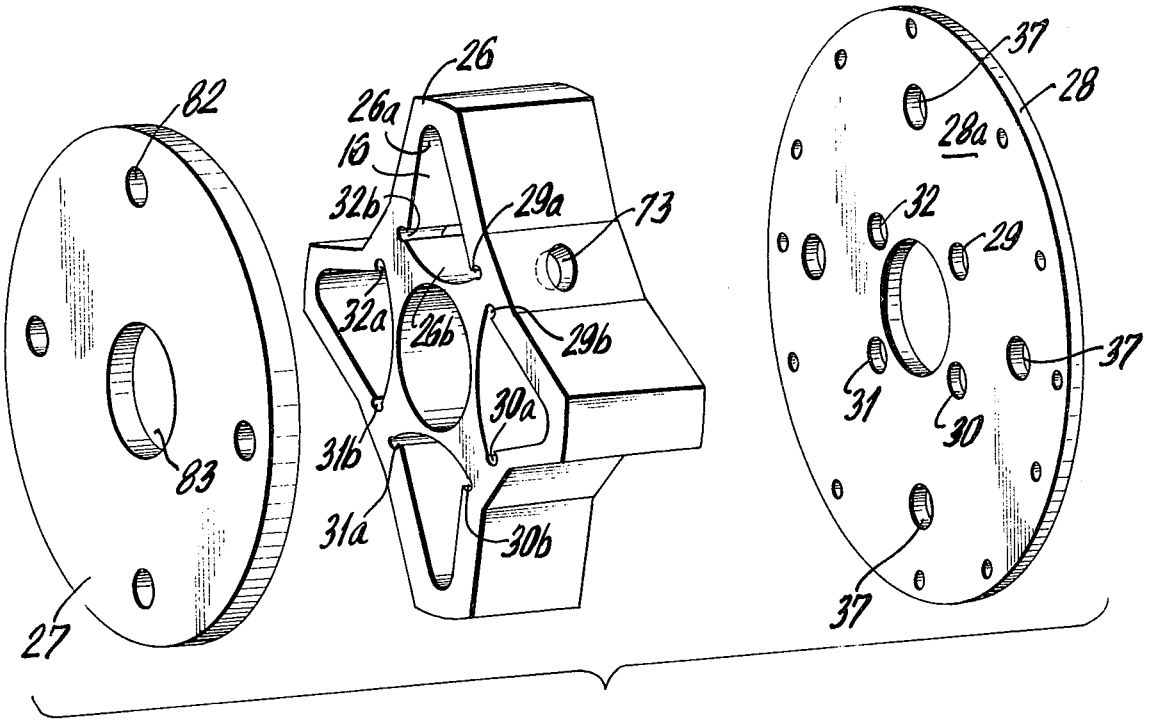
FIG. 12 is an isometric drawing showing a partially expanded view of the engine block and first and second circular discs 27 and 28 respectively.

FIG. 12 is an isometric drawing showing a partially expanded view of the engine block 26 and the first disc 27 and second disc 28. In this drawing the means of communication between the chambers 16, the ports 29, 30, 31, 32 and the channel portions 29(*a*, *b*), 30(*a*, *b*), 31(*a*, *b*) and 32(*a*, *b*), respectively, can readily be seen. The first circular disc 27 is bolted or otherwise fixedly connected to one side of the engine block 26 and second circular disc 28 is bolted or otherwise fixedly connected to the opposite side of the engine block. The chambers 16 are tightly sealed between the first and second circular discs by gasket means not shown.

The engine block 26 has four chambers 16. The chambers 16 are generally triangular in shape and are spaced 90° apart. The apex of the triangle is away from the central axis of the engine. The angle at the apex of the triangle can be 30° to 180° and preferably 60° to 80°. The base of the triangle is curved to form the outer circumference of a circle having its center at the center of shaft 2.

FIG. 13 is a three dimensional expanded view showing the second circular disc 28, rotary valve 33, and end plate 38. In this drawing the means for providing communication between ports 29, 30, 31 and 32 and exhaust groove 35, connecting channel 35*a*, groove 35*b*, exhaust ring 39 and exhaust port 40 and the means for providing communication between ports 29, 30, 31 and 32 and fuel inlet groove 34, fuel inlet ring 41 and inlet port 42 can be seen.

The rotation counter-clockwise of rotary valve 33, brings exhaust groove 35 and inlet groove 34, in turn in contact with each of the ports 32, 31, 30 and 29, whereby the combustion chambers each go through the four cycles of exhaust, intake, compression and combustion for each 360° rotation of rotary valve 33.

The exhaust groove 35 and the inlet groove 34 are dimensioned such that when centered between, for example, ports 32 and 29, and ports 29 and 30, respectively, neither is in contact or communication with any of the ports or chambers 16.

Exhaust groove 35 is about the same size and shape as fuel inlet groove 34 and is spaced 90° from groove 34. Groove 35 and groove 34 are about the same radial distance from the central axis of the rotary valve 33. Groove 35 does not go all the way through rotary valve 33. Groove 35 can have a depth about ⅓ the thickness of rotary valve 33. Groove 35*b* is on the side of rotary valve 33 which is opposite groove 35 and is radially offset from groove 35. Groove 35*b* can have a depth of about ⅓ the thickness of the rotary valve 33. Grooves 35 and 35*b* are connected by connecting passage 35*a*. Connecting passage 35*a* can be parallel to the plane of rotary valve 33 and can have a thickness of about ⅓ the thickness of rotary valve 33 such that it overlaps both groove 35 and groove 35*b* providing communication between the two grooves. The exhaust groove 35*b* is always in communication with annular exhaust ring 39 and exhaust port 40 in end plate 38. Annular exhaust ring 39 does not extend all the way through end plate 38 and is of sufficient depth and width to provide adequate cross-sectional area for the volume of combustion gases expelled. When exhaust groove 35 is in contact with port 29, combustion gases will pass from chamber 16 through port 29, exhaust groove 35, connecting passage 35*a*, exhaust groove 35*b*, annular exhaust ring 39 and exhaust port 40 to the exterior of the engine. When the exhaust groove 35 is not in contact with port 29, or any of the other ports 30, 31 or 32, exhaust gases cannot leave the chambers 16.

Inlet groove 34 extends through rotary valve 33 and is always in communication with annular fuel intake ring 41, and through fuel inlet port 42 is in communication with the fuel source. The annular ring 41 does not extend through the wall of end plate 38 and is of sufficient depth and width to provide adequate cross-sectional area to supply fuel to the engine. When the inlet groove 34 is in contact with port 29, fuel mixture will pass into the chamber 16 When inlet groove 34 is not in communication with port 29 or one of the other ports 30, 31 or 32, fuel will not pass into any of the chambers 16.

The rotary valve 33 fits into the end plate 38. The rotary valve 33 and the end plate 38 are closely dimensioned to provide a rotatable but tight sealing fit such that there is no communication between exhaust groove 35*b* and inlet groove 34 or between annular exhaust ring 39 and annular inlet ring 41.

Similarly the rotary valve 33 and the second circular disc 28 have a rotatable tight sealing fit such that except when groove 35 or groove 34 are in contact with one of the ports 29, 30 31 or 32, there is no communication between either of the grooves and any of the chambers 16. Rotary valve 33 can be suitably made by sand casting it is one piece or by making it in two pieces and welding it together.

FIG. 14

FIG. 14 is an end view taken generally along line G—G of FIG. 1 looking in the direction indicated by the arrows showing a view of end plate 38, exhaust port 40 and fuel inlet port 42. Legs 78 carry and support the engine and are secured to engine mount 86 by bolts 85. FIG. 14 of the drawing also shows a conventional type of commutator ignition ring means which can be used for timing a spark coil to control ignition. Metal conductors 91 are carried on shaft 22 and are separated by insulators 92. Roller 93 is spring biased by spring conductor 94 to intermittently contact conductor 91. Line 95 is electrically connected to conductor 94 and to a suitable spark coil means.

In the embodiment of the engine described above in FIGS. 1 to 14 of the drawings, the rectangular piston plate can be very closely dimensioned with respect to the inner wall surface 27*a* of first circular disc 27, the inner wall surface 28*a* of the second circular disc 28 and the inner wall surfaces 26*b* of the engine block 26 such that the engine can be operated without separate gas seal or bearing means at the sides and/or outer edge of the piston plate 1. The sizing of the rectangular piston plate with respect to the inner wall surfaces of the combustion chamber is very closely controlled. The clearance between each side edge and the outer edge of the piston plate and surface of the combustion chamber is closely controlled. Because of the very rapid oscillatory motion of the piston plate in the combustion chamber and the very close tolerances, the exhaust, the intake, compression and combustion power cycles can be carried out without substantial loss of gas pressure into or out of the combustion chamber. In order to improve the operation of the engine, the edges of the piston plate and/or the said inner wall surfaces of the combustion chamber can be suitably treated by known means to improve the gas seal and contact between the surfaces.

The rotary engines of the present invention can be built throughout the same horsepower and displacement range as conventional lawn mower, motorcycle, automobile, truck, marine and aircraft engines with the important difference that the engines of this invention will be approximately 30 to 60 percent lighter in weight and one third to one fourth the size for the same displacement and horsepower. Engines having one or two combustion chambers are particularly useful for lawn mowers, motorcycles and small cars. Engines having two or four or more combustion chambers are particularly useful for automobiles and trucks and for boats and aircraft. Each type of engine can be adapted for single or dual firing.

Depending on the size, power output and the particular use for the engine, the power can be taken off through the main shaft, a suitable clutch plate, automatic transmission, chain, pulley and/or gear means. Ignition can be provided by a convention spark or glow plug and coil or by a conventional diesel type firing. The firing of the engine is in sequence, for example, counter-clockwise as shown in FIG. 6. The timing of the firing can be controlled by a commutator ignition means, for example, as shown in FIG. 14. The engine is designed to operate on a wide range of fuels from low octane to high octane gasoline, diesel fuel, kerosene, alcohol, and liquified gases such as propane, butane, natural gas, etc. Where a medium octane fuel is used, it can be mixed with air in a carburetor and throttled to the intake manifold. Alternatively, the fuel and air can be fed to the engine by fuel injection means using conventional automotive equipment.

The engine is both lubricated and cooled by means of oil. The oil fills the interior portion of the translation case. Because of the rotary motion of the gears and the motion of the moving parts, the oil will be forced outwardly to cool and lubricate the engine parts in the translation case. The warm oil is cycled to an air or water cooled radiator means or other suitable heat exchange means and cooled prior to returning to the engine. The combustion chambers are preferably air cooled but can be suitably jacketed and water cooled. The various engine parts such as the translation case, engine block, first and second circular discs and end plates can be bolted, welded and/or otherwise fastened together. The engine parts are easily made by forging, casting and machining. The engine parts can be made of cast or forged iron, steel or aluminum. The engine can easily be assembled by moderately skilled labor. Repair and maintenance of the engine is equally simple.

It is to be understood that the form of the invention herein shown and described is to be taken as an illustrative example thereof and that various changes in the shape, size and arrangement of parts may be resorted to without departing from the spirit of the invention such that the scope thereof should be limited only to the scope of the appended claims.

What is claimed:

1. An internal combustion engine comprising, an engine block containing at least two combustion chambers, translation gear means and rotary valve means, means which oscillate back and forth in said combustion chambers, a separate shaft fixedly connected to each of said oscillating means, and a main shaft carried by said engine block, the translation gear means being disposed adjacent only a single side of the combustion chambers and the rotary valve means being disposed adjacent only a single side of the combustion chambers and opposite the side on which the translation gear means is disposed, the combustion chambers including exhaust outlet means and fuel intake means and the engine block containing ignition means, the main shaft being connected to the rotary valve means, said translation gear means operably connecting each of the oscillating means shafts to the main shaft, whereby during the combustion power cycle, the oscillatory motion of said oscillating means is transmitted and converted to rotary motion of the main shaft and rotary valve means.

2. The internal combustion engine of claim 1 adapted for single firing of each combustion chamber in which the combustion chamber has an inlet and outlet means on only one side of the oscillating means.

3. The internal combustion engine of claim 1 adapted for dual firing of each combustion chamber in which the combustion chamber has an inlet and outlet means on each side of the oscillating means.

4. The internal combustion engine of claim 1 in which the combustion chamber has inlet and outlet means, the rotary valve has inlet and outlet means, the combustion chamber inlet and outlet means being operably connected to the rotary valve inlet and outlet means, such that during the oscillatory motion of the oscillating means and the rotary motion of the rotary valve means the respective inlet and outlet means are in turn brought into communication each with the other.

5. An internal combustion engine comprising, an engine block, at least two combustion chambers, a translation gear means and a rotary valve means operably connected to said combustion chambers, piston plates which oscillates inwardly and outwardly in said combustion chambers, a separate shaft fixedly connected to one end of each of the piston plates and operably connected to said engine block and a main shaft, said combustion chambers having an inlet and outlet means, said rotary valve means having an inlet and outlet means, the combustion chambers inlet and outlet means being operably connected to the rotary valve inlet and outlet means, such that during the oscillatory motion of the piston plates and the rotary motion of the rotary valve means, the respective inlet and outlet means are in turn brought into communication each with the other, said translation gear means including first linking means fixedly connected to each of the piston plate shafts, second linking means operably connected to each of said first linking means; throws, drive gears and a main gear, the main gear being connected to the main shaft which is connected to the rotary valve means, the rotary valve being disposed adjacent only a single side of the combustion chambers, said throws and drive gears being operably connected to each of said second linking means, whereby the oscillatory motion of the piston plates is transmitted, during the combustion-power cycle, through each of said piston plate shafts and first and second linking means and throws and is converted to rotary motion of said drive gears which drive against said main gear causing said main gear, main shaft and rotary valve to rotate.

6. The internal combustion engine of claim 5 wherein the engine carries at one end an end plate, said end plate contains an annular exhaust ring and an annular fuel inlet ring, the combustion chamber contains a port which is in operable relationship with the rotary valve, one side of said rotary valve contains, displaced about the same radial distance a first exhaust groove and a fuel inlet groove, the opposite side of the rotary valve contains a second exhaust groove which is radially displaced outwardly from the first exhuast groove and the fuel inlet groove, the annular exhaust ring and fuel inlet ring are in communication with the second exhaust groove and the fuel inlet groove, respectively, and rotation of the rotary valve brings the exhaust groove and the fuel inlet, in turn, into communication with the port and the combustion chamber.

7. The internal combustion engine of claim 6 wherein the rotary valve has a passage connecting the first exhaust groove and the second exhaust groove.

8. The internal combustion engine of claim 5 wherein the engine carries at one end an end plate, the end plate contains an annular exhaust ring and an annular fuel inlet ring, the rotary valve contains an exhaust groove and a fuel inlet groove, wherein the exhaust groove is in communication with the annular exhaust ring and the inlet groove is in communication with the annular inlet groove.

9. The internal combustion engine of claim 5 in which the engine block contains at least four combustion chambers.

10. The internal combustion engine of claim 5 in which the combustion chambers are adapted for single firing in which the combustion chamber has an inlet and outlet means on only one side of the oscillating means.

11. The internal combustion engine of claim 5 in which the combustion chambers are adapted for dual firing in which the combustion chamber has inlet and outlet means on each side of the oscillating means.

12. An internal combustion engine comprising an engine block, at least one combustion chamber and a translation gear case, said translation gear case being spaced away from said combustion chamber; a piston plate which oscillates back and forth in said combustion chamber, a shaft fixedly connected to one end of the piston plate and operably connected to said engine block and a main shaft carried by the engine block; heat expansion means providing radial and lateral heat expansion of portions of the engine block and combustion chamber relative to portions of the translation gear case; means in said translation gear case operably connecting the piston plate shaft to the main shaft, including a first linking means fixedly connected to the piston plate shaft, a second linking means operably connected to said first linking means, a throw, a drive gear and a main gear, the main gear being connected to the main shaft, said throw and drive gear being operably connected to said second linking means whereby the oscillatory motion of the piston plate is transmitted during the combustion power cycle, through said piston plate shaft and first and second linking means and throw and is converted to rotary motion of said drive gear which drives against said main gear causing said main gear and main shaft to rotate.

13. The internal combustion engine of claim 12 wherein the engine block is fixedly connected to first and second circular discs and the translation gear case has a wall adjacent to the first circular disc, in which engine the inner wall surfaces of the first and second circular discs form walls of the combustion chamber, the outer wall of the first circular disc and the adjacent wall of the translation gear case contain cooperating means to allow for radial and longitudinal heat expansion of portions of the engine block and combustion chamber relative to portions of the translation gear case.

14. The internal combustion engine of claim 12 in which the translation gear case is sealed from the atmosphere except for oil lubricating inlet and outlet means and in which lubricating oil is not brought into contact with hot combustion gases.

15. An internal combustion engine comprising an engine block containing at least one combustion chamber and a translation gear case, said translation gear case being spaced away from said combustion chamber, means which oscillate back and forth in said combustion chamber, a shaft fixedly connected to said oscillating means, a main shaft carried by said engine block, the translation gear case being disposed adjacent only a single side of the combustion chamber, heat expansion means providing radial and lateral heat expansion of portions of the engine block and combustion chamber relative to portions of the translation gear case, means in the translation gear case operably connecting the oscillating means and shaft to the main shaft, whereby during the combustion power cycle the oscillatory motion of said oscillating means is transmitted and converted to rotary motion of the main shaft.

16. An internal combustion engine comprising an engine block containing at least two combustion chambers, a translation gear case and a rotary valve means, said translation gear case being spaced away from said combustion chambers, means which oscillate back and forth in said combustion chambers, a shaft fixedly connected to each of said oscillating means, a main shaft carried by said engine block, heat expansion means providing radial and lateral heat expansion of portions of the engine block and combustion chambers relative to portions of the translation gear case, said combustion chambers having inlet and outlet means, said rotary valve means having inlet and outlet means, the combustion chambers inlet and outlet means being operably connected to the rotary valve inlet and outlet means, such that during the oscillatory motion of the oscillating means and the rotary motion of the rotary valve means, the respective inlet and outlet means are in turn brought into communication each with the other, means in the translation gear case operably connecting the oscillating means and shafts to the main shaft, the main shaft being connected to the rotary valve means, whereby during the combustion power cycle, the oscillatory motion of said oscillating means is transmitted and converted to rotary motion of the main shaft and rotary valve means.

17. An internal combustion engine comprising an engine block, at least one combustion chamber, a translation gear case and a rotary valve means, said translation gear case being spaced away from said combustion chamber, a piston plate which oscillates back and forth in said combustion chamber, a shaft fixedly connected to one end of the piston plate and operably connected to said engine block, and a main shaft carried by said engine block, the translation gear case being disposed adjacent only a single side of the combustion chamber, heat expansion means providing radial and lateral heat expansion of portions of the engine block and combustion chamber relative to portions of the translation gear case, said combustion chamber having an inlet and outlet means, said rotary valve means having an inlet and outlet means, the combustion chamber inlet and outlet means being operably connected to the rotary valve inlet and outlet means, such that during the oscillatory motion of the piston plate and the rotary motion of the rotary valve means, the respective inlet and outlet means are in turn brought into communication each with the other, the translation gear case containing a first linking means fixedly connected to the piston plate shaft, a second linking means operably connected to said first linking means, a throw, a drive gear and a main gear, the main gear being connected to the main shaft which is connected to the rotary valve means, the rotary valve means being disposed adjacent only a single side of the combustion chamber and opposite the side on which the translation gear case is disposed, said throw and drive gear being operably connected to said second linking means, whereby the oscillatory motion of the piston plate is transmitted during the combustion power cycle, through said piston plate shaft and first and second linking means and throw and is converted to rotary motion of said drive gear which drives against the main gear causing said main gear, main shaft and rotary valve to rotate.

18. An internal combustion engine comprising an engine block containing at least one combustion chamber, rotary valve means and a main shaft carried by said engine block, and linking means; the engine carries at one end an end plate, said end plate contains an annular exhaust ring and an annular fuel inlet ring, the combustion chamber contains means which oscillate back and forth therein and a port; a shaft is fixedly connected to said oscillating means, the main shaft is connected to the rotary valve means, the rotary valve means is disposed adjacent only a single side of the combustion chamber; the combustion chamber port is in operable relationship with the rotary valve means, one side of the rotary valve means contains, displaced about the same radial distance, a first exhaust groove and a fuel inlet groove, the opposite side of the rotary valve contains a second exhaust groove which is radially displaced outwardly from the first exhaust groove and the fuel inlet groove, the annular exhaust ring and fuel inlet ring are in communication with the second exhaust groove and the fuel inlet groove, respectively; said linking means operably connect the oscillating means and the shaft to the main shaft, whereby during the combustion power cycle the oscillatory motion of said oscillating means is transmitted and converted to rotary motion of the main shaft and rotary valve means, which rotary motion brings the rotary valve exhaust groove and fuel inlet groove, in turn, into communication with said combustion chamber port.

19. The internal combustion engine of claim 18 wherein there is a connecting passage connecting the rotary valve first exhaust groove and second exhaust groove.

* * * * *